US006254668B1

(12) United States Patent
Huang

(10) Patent No.: US 6,254,668 B1
(45) Date of Patent: Jul. 3, 2001

(54) DEVICE FOR CLEANING A STATIC PRECIPITATOR

(76) Inventor: Mei-Ling Huang, 2F, No. 8-1, Lane 15, Yu-Sheng St., Shih-Lin Dist., Taipei (TW)

( * ) Notice: Subject to any disclaimer, the term of this patent is extended or adjusted under 35 U.S.C. 154(b) by 0 days.

(21) Appl. No.: 09/619,534

(22) Filed: Jul. 19, 2000

Related U.S. Application Data

(62) Division of application No. 09/199,804, filed on Nov. 25, 1998, now Pat. No. 6,187,078.

(30) Foreign Application Priority Data

Dec. 2, 1997 (TW) ..... 86118124

(51) Int. Cl.[7] ..... B03C 3/80

(52) U.S. Cl. ..... 96/18; 96/25; 96/43; 96/44; 96/50; 96/55; 96/58; 96/64

(58) Field of Search ..... 96/18, 25, 43, 96/44, 50, 55, 58, 64, 57; 95/2, 74, 75; 55/302, 282.2

(56) References Cited

U.S. PATENT DOCUMENTS

| | | | | |
|---|---|---|---|---|
| 1,284,166 | * | 11/1918 | Welch | 96/44 X |
| 3,714,762 | * | 2/1973 | Fillies et al. | 96/43 X |
| 4,294,591 | * | 10/1981 | Kahl | 96/43 |
| 4,940,471 | * | 7/1990 | Penney | 96/43 |
| 5,137,546 | * | 8/1992 | Steinbacher et al. | 96/44 X |
| 5,334,238 | * | 8/1994 | Goodson et al. | 96/50 X |
| 5,601,791 | * | 2/1997 | Plaks et al. | 95/75 X |
| 5,893,943 | * | 4/1999 | Durham et al. | 96/50 X |
| 5,956,946 | * | 9/1999 | Yamada | 95/74 X |

FOREIGN PATENT DOCUMENTS

| | | | | |
|---|---|---|---|---|
| 4126431 | * | 2/1993 | (DE) | 95/74 |
| 702865 | * | 1/1954 | (GB) | 96/50 |
| 45-21877 | * | 7/1970 | (JP) | 96/44 |
| 4-317755 | * | 11/1992 | (JP) | 96/44 |
| 375097 | * | 3/1973 | (SU) | 96/43 |

* cited by examiner

*Primary Examiner*—Richard L. Chiesa
(74) *Attorney, Agent, or Firm*—Dougherty & Troxell

(57) ABSTRACT

A device for cleaning static precipitator in which hot air and steam are repeatedly filled into an oil-collecting sink of the static precipitator at different times or at the same time for heating and melting the oil dirt attaching to the static panels, making the oil dirt drop down into a collecting section. The static panels can be harmlessly cleaned up without disassembly or using any scraper. Hot air also serves to shorten the drying time for the static panels.

34 Claims, 5 Drawing Sheets

DEVICE FOR CLEANING A STATIC PRECIPITATOR

RELATED APPLICATION

This is a Divisional application of U.S. Ser. No. 09/199,804, filed Nov. 25, 1998, entitled METHOD FOR CLEANING A STATIC PRECIPITATOR, and now U.S. Pat. No. 6,187,078.

BACKGROUND OF THE INVENTION

The present invention relates to a device for cleaning static precipitator, in which hot air and steam are used to heat and melt the oil dirt attaching to the static panels, making the oil dirt drop down into a collecting section. Accordingly, the static panels are effectively and harmlessly cleaned up.

In a conventional static precipitator, the oil drops passing through the space between the static panels are ionized by way of high voltage discharging. The ionized oil drops are attracted to attach to the static panels. After a period of use, excess oil drop will accumulate on the surface of the static panels. This will deteriorate the attractive force of the static panels and may lead to short circuit of the static panels or even cause sparks.

Conventionally, the oil dirt accumulating on the static precipitator is cleared in such a manner that the static panels are detached and immerged in a detergent. Alternatively, a detergent is sprayed onto the static panels which are then washed and flushed by clean water. After being totally dried, the static panels are installed back into the oil-collecting sink of the static precipitator. Such cleaning procedure is quite troublesome and time-consuming and much waste water will be produced, which is difficult to process. An improved measure has been developed, which employs a sprinkler in the oil-collecting sink to directly sprinkle a detergent and water onto the static panels and wash the same. Accordingly, it is no more necessary to detach the static panels and much labor and time are saved. However, still a great amount of waste water is produced. Moreover, it will be more difficult and time-consuming to dry the static panels in the oil-collecting sink.

Another improved measure has been developed to remove the oil dirt in such a manner that the static panels are circularly moved and in the moving path, a scraper is used to scrape off the oil dirt. In such measure, the static panels tend to deflect during moving. In addition, the static panels are subject to scraping of the scraper for a long time and are likely to damage. Also, such measure has complicated structure.

Furthermore, when maintained, the conventional devices must be stopped from operating and it often takes much time to complete the maintenance. Therefore, the operation of the static precipitator is often interrupted for a long time.

SUMMARY OF THE INVENTION

It is a primary object of the present invention to provide a device for cleaning static precipitator in which hot air is filled into the oil-collecting sink through a hot air filling pipe for heating and melting the oil dirt attaching to the static panels, making the oil dirt drop down into a collecting section so as to clean up the static panels.

It is a further object of the present invention to provide the above device, in which steam is further filled into the oil-collecting sink through a steam filling pipe to further clean up the oil dirt remaining on the static panels.

It is still a further object of the present invention to provide the above device, in which sealing devices are disposed near two ends of the oil-collecting sink for sealing the air inlet and air outlet of the oil-collecting sink during heating procedure so as to maintain a high temperature therein.

It is still a further object of the present invention to provide the above device, in which the inner side of the front end of the oil-collecting sink is disposed with a flow-guiding filtering screen near the air inlet. The filtering screen serves to filter the coarse pollutant particles entrained by the air. The filtering screen also serves to make the air evenly flow through the static panels to enhance the oil-cleaning effect. An activated carbon filter device is installed in the rear end of the oil-collecting sink. The air flow which is free from the oil drops can further pass through the activated carbon filter device to be filtered from the odor and gas pollutant and then exhausted so as to ensure the quality of the exhausted air.

It is still a further object of the present invention to provide the above device, in which a fire device is mounted outside the oil-collecting sink. A thermosensor of the fire device serves to detect the temperature and in the case of abnormal temperature, the thermosensor is able to activate the fire device and the sealing device at the same time to isolate the air and inject a fire-extinguishing material into the oil-collecting sink to extinguish the fire. The sealing device can be a movable door. During the cleaning operation or maintenance of the static precipitator, the movable door is turned to close the air passage of the static precipitator. At this time, the air is guided and exhausted by a bypass. Therefore, the static precipitator can continuously exhaust the oil drop at the same time when maintaining the internal equipments in the oil-collecting sink without interruption of the operation of the static precipitator.

The present invention can be best understood through the following description and accompanying drawings, wherein:

DETAILED DESCRIPTION OF THE PREFERRED EMBODIMENTS

Figure 1:
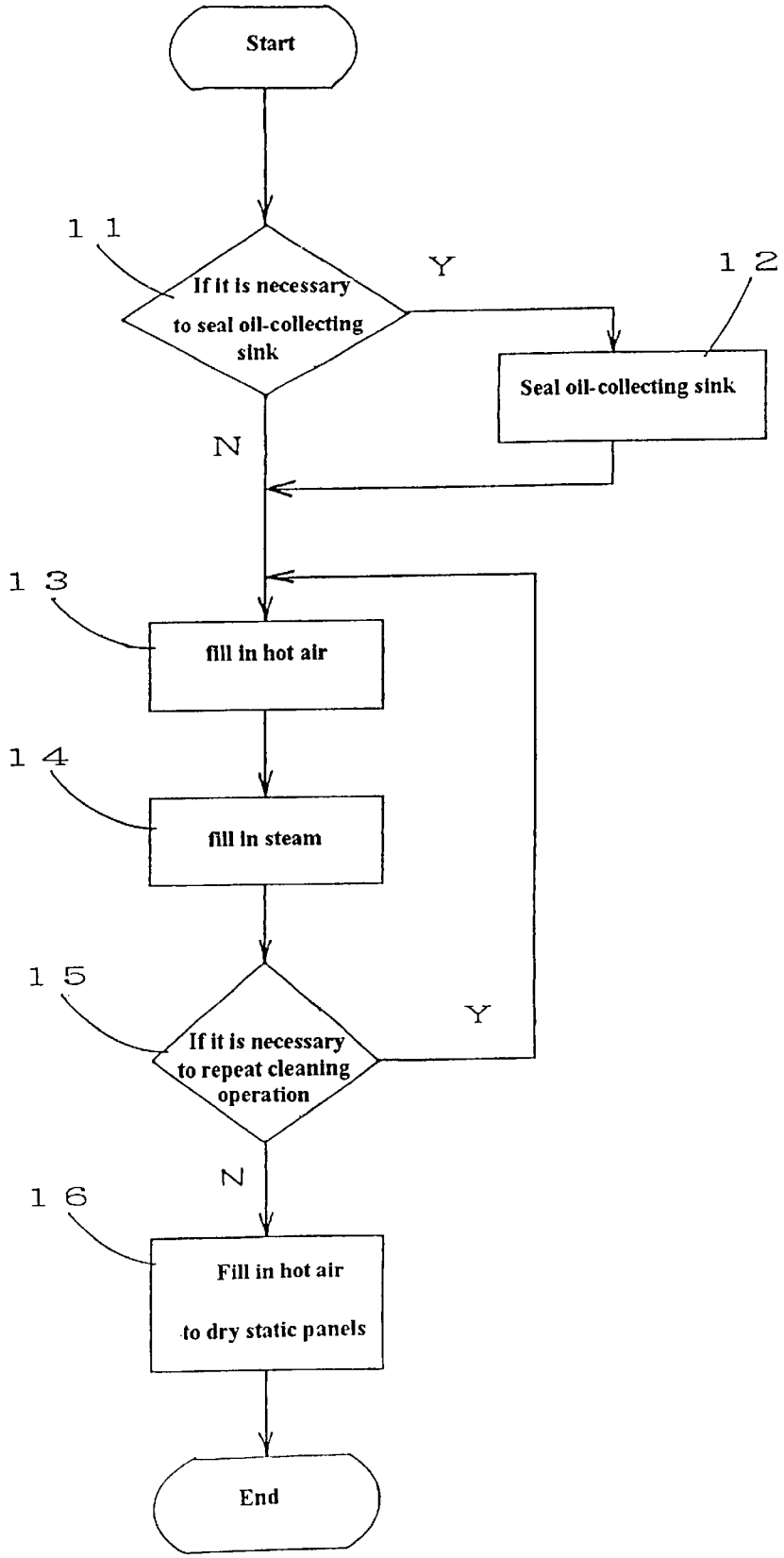
FIG. 1 is a flow chart of the oil dirt-cleaning operation of the present invention.

Please refer to FIG. 1 which shows the flow chart of. The oil dirt cleaning procedure of the present invention includes the following steps: In step 11 "if it is necessary to seal the oil-collecting sink", according to the peripheral equipments and actual requirements, it is judged whether it is necessary to seal the oil-collecting sink. If so, step 12 "sealing oil-collecting sink" is performed. If no, then step 13 "filling in hot air" is performed. The hot air is filled in to heat the static panels to make the oil dirt attaching to the surfaces thereof thermally melt and separate therefrom and drop down so as to achieve a preliminary cleaning effect. Then, in step 14 "filling in steam", steam is used to further heat and melt the oil dirt remaining on the static panels so as to achieve a further cleaning effect. Then, in step 15 "if it is necessary to repeat cleaning", it is judged whether it is necessary to repeat the cleaning operation. If so, the steps 13, 14 are repeated. Otherwise, step 16 "filling in hot air to dry static panels" is performed so as to shorten the drying time. According to the above procedure, the cleaning operation of the static panels is completed. Alternatively, in the procedure, the filling of hot air and steam can be performed simultaneously to shorten cleaning time and enhance the cleaning effect.

Figure 2:
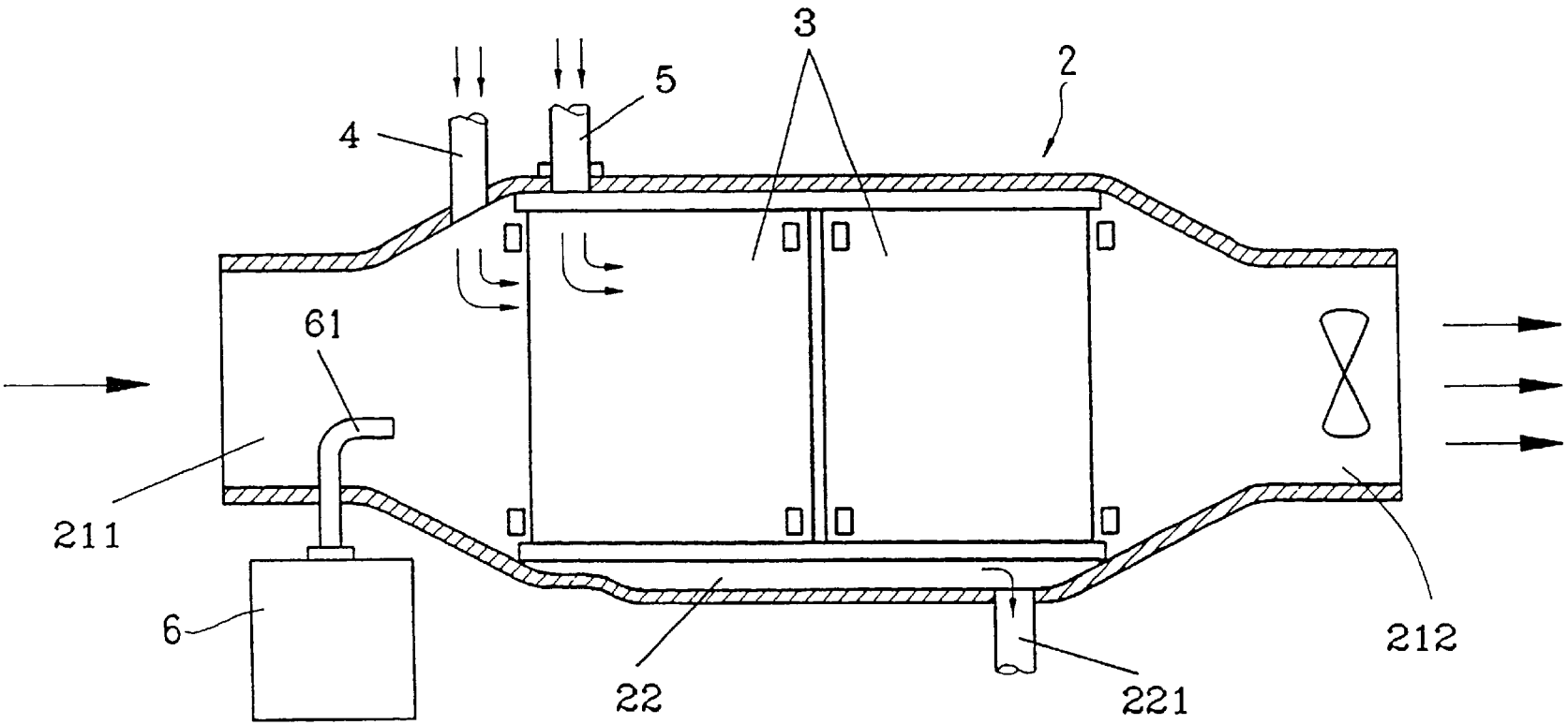
FIG. 2 is a sectional view showing the structure of the cleaning device of the present invention.

FIG. 2 shows the entire structure of the present invention, which includes an oil-collecting sink 2, static panels 3, hot air filling pipe 4 and steam filing pipe 5. Two ends of the oil-collecting sink 2 are respectively disposed with an air inlet 211 and an air outlet 211. A middle section of the oil-collecting sink 2 is disposed with a recessed collecting section 22. The bottom of the collecting section 22 is disposed with an oil draining pipe 221 communicating with outer side. The static panels 3 are parallelly arranged in the oil-collecting sink 2. The hot air filling pipe 4 and the stream-filling pipe 5 are disposed on one side of the oil-collecting sink 2 adjacent to the air inlet 211. A fire device 6 is additionally mounted outside the oil-collecting sink 2 with a nozzle 61 extending into the oil-collecting sink 2.

After a period of use and when it is necessary to clean up the oil dirt accumulating on the surfaces of the static panels 3, the hot air is filled in through the hot air filling pipe 4 to heat the static panels 3 and melt the oil dirt on the surfaces thereof. The molten oil dirt then gradually drops down into the collecting section 22 of the oil-collecting sink 2 and drained out from the draining pipe 221. After a period of time by which the hot air is filled in, the steam is filled in through the steam-filling pipe 4 to more quickly clean up the oil dirt remaining on the static panels 3 and achieve a further cleaning effect. The hot air and steam are repeatedly filled into the oil-collecting sink 2 so as to quickly and harmlessly clean up the static panels 3. The hot air and steam can be simultaneously filled into the oil-collecting sink to enhance the cleaning effect.

In the case of abnormal temperature in the oil-collecting sink 2 (for example, the oil dirt on the surfaces of the static panels 3 is burned due to discharging sparks), a thermosensor of the fire device 6 can detect the temperature to in time activate the fire device 6, making the nozzle 61 inject in fire-extinguishing material for avoiding fire.

Figure 3:
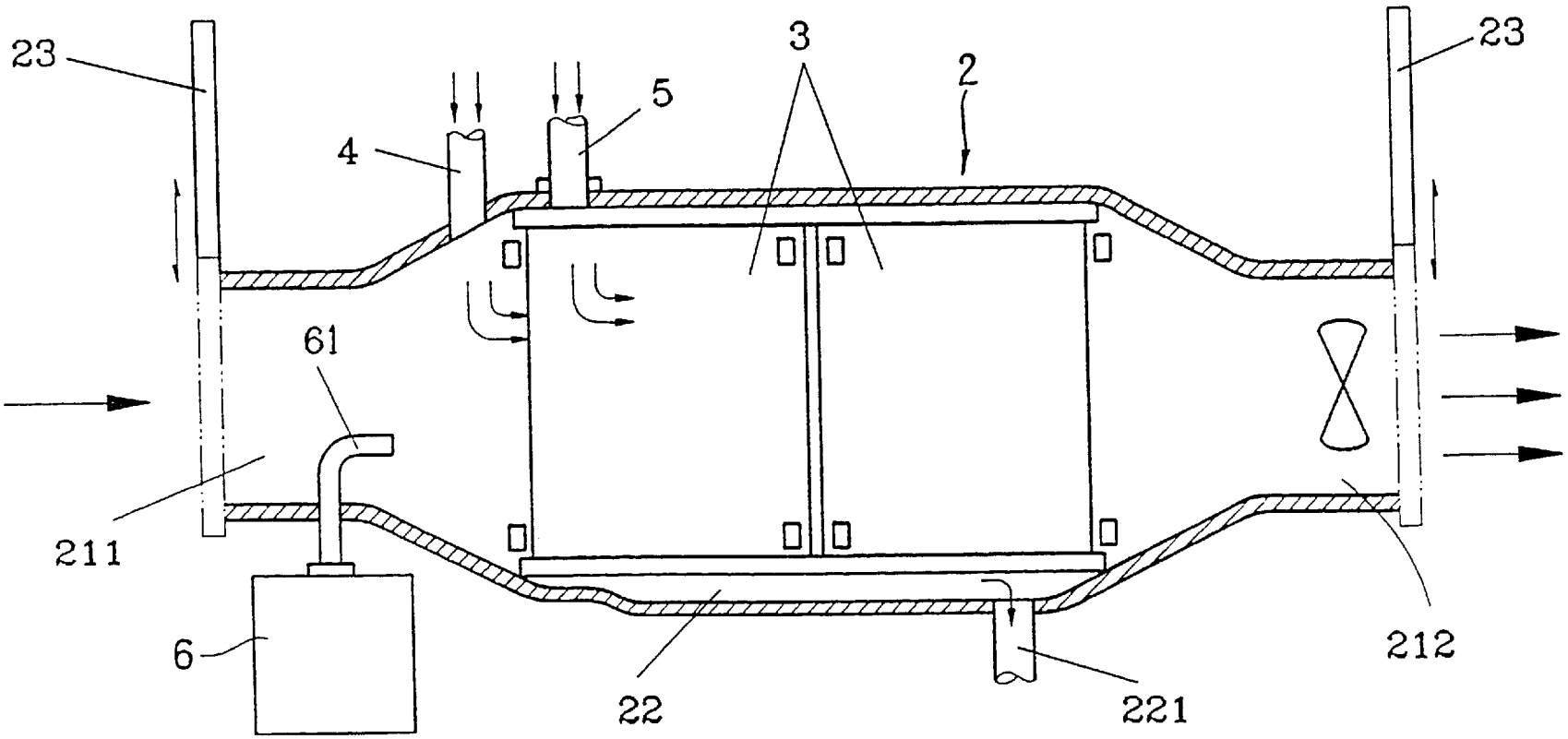
FIG. 3 is a view according to FIG. 2, in which the cleaning device is used with sealing devices.

Please refer to FIG. 3. Two sealing devices 23 can be disposed on two sides of the oil-collecting sink 2 adjacent to the air inlet and air outlet 211, 212. In the case that the static panels 3 are cleaned or the fire device 6 operates in an emergency (for example, the oil dirt burns in the oil-collecting sink 2 or at the static panels 3), the sealing devices 23 serve to seal the air inlet and outlet 211, 212 to enhance the cleaning or fire-extinguishing effect and protect other relevant equipments from being damaged and ensure safety of personnel and properties.

Figure 4:
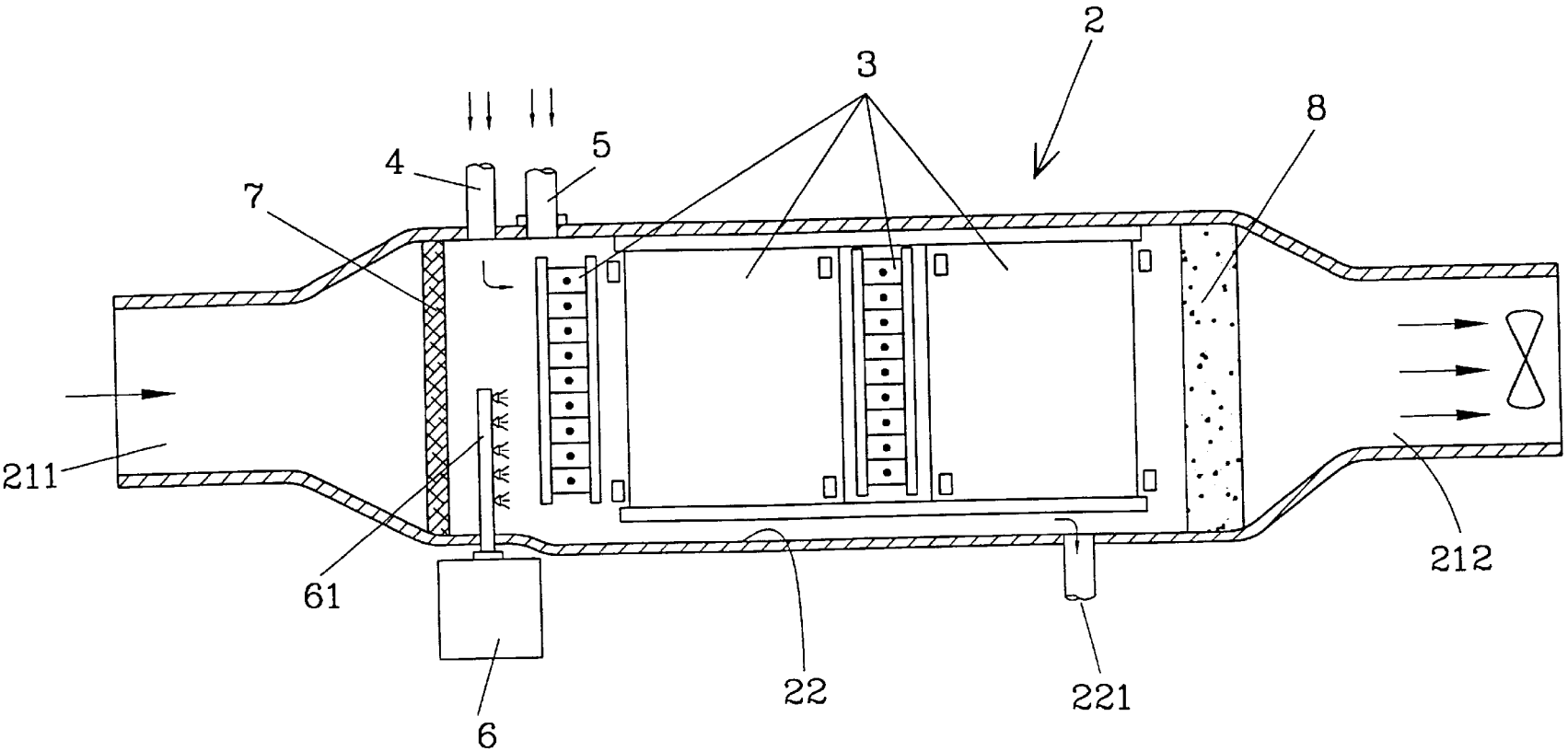
FIG. 4 is a sectional view of another embodiment of the cleaning device of the present invention.
Figure 5:
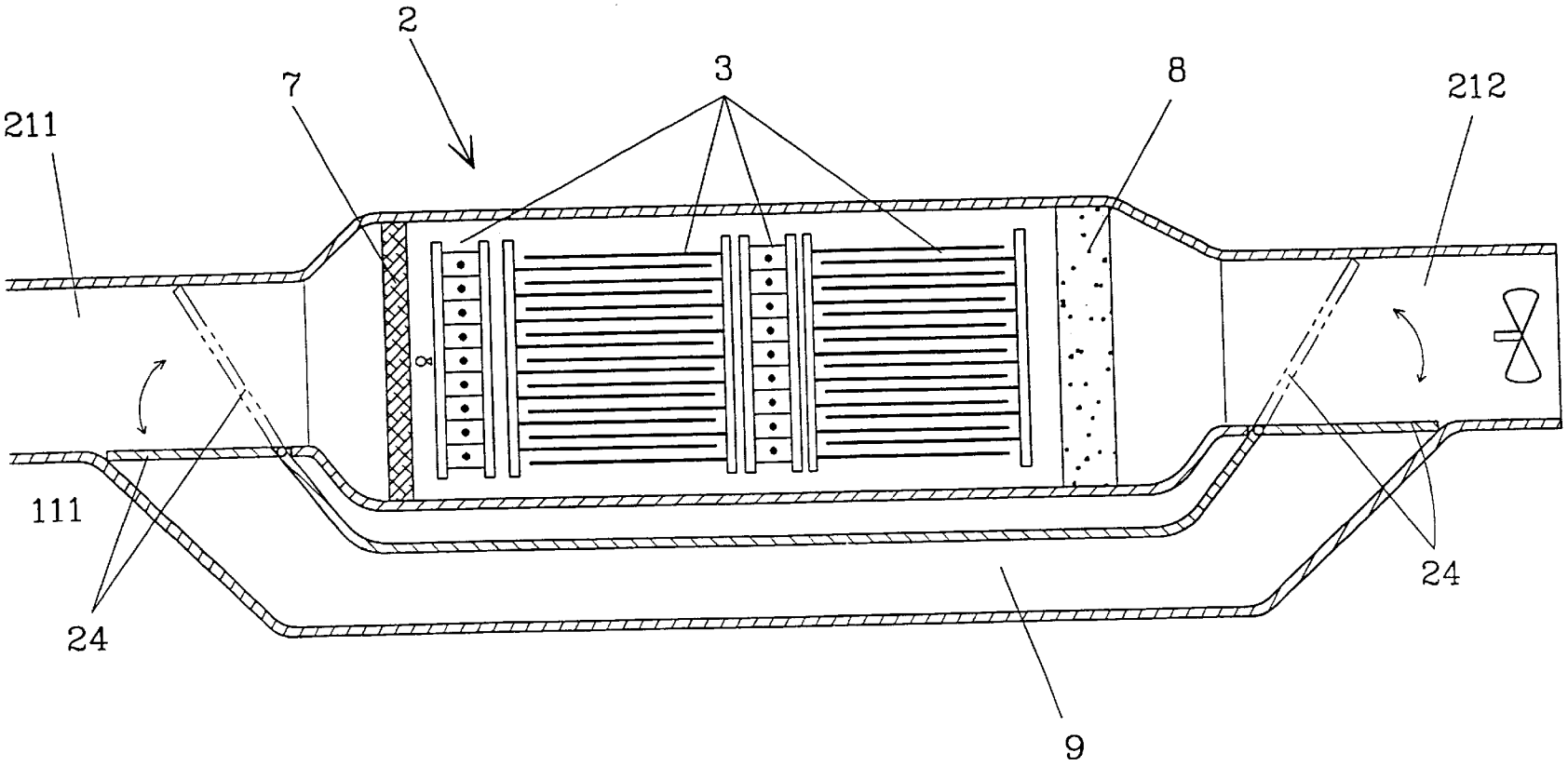
FIG. 5 is a view according to FIG. 4, seen by another angle.

Please refer to FIGS. 4 and 5. In order to achieve a filtering effect and purify the exhausted air, the inner side of the front end of the oil-collecting sink is disposed with a flow-guiding filtering screen 7 near the air inlet 211. The filtering screen 7 serves to preliminarily filter the coarse pollutant particles in the air so as to prevent the internal static panels 3 from being contaminated such pollutant particles. The filtering screen 7 also serves to even the airflow so as to even and enhance the filtering effect. In addition, an activated carbon filter device 8 is installed in the rear end of the oil-collecting sink 2 near the air outlet 212. The air flow which is free from the oil drops can further pass through the activated carbon filter device 8 to be filtered from the odor and gas pollutant so as to purify the exhausted air.

At least one side of the oil-collecting sink 2 is formed with an openable door which can be opened for taking out or maintaining the above filtering screen 7, static panels 3, activated carbon filter device 8 and other relevant equipments disposed in the oil-collecting sink 2.

As shown in FIGS. 4 and 5, the sealing device 23 can be a movable door 24 which can be turned from a lateral side to inner side. The outer side of the movable door 24 is disposed with a bypass 9, whereby when the movable door 24 is turned inward, the air passage of the static precipitator is just closed. At this time, the bypass 9 serves as an air passage. Therefore, the static precipitator can continuously exhaust the oil drop at the same time when taking, disassembling or maintaining the internal equipments in the oil-collecting sink 2. After the maintenance is completed, the movable door 24 is restored to its home position, permitting the oil drops to pass through the air passage in which the static panels 2, filtering screen 7 and activated carbon filter device 8 are located. Therefore, the air exhaustion operation is not interrupted to meet the requirements of actual use.

It should be noted that the above description and accompanying drawings are only used to illustrate some embodiments of the present invention, not intended to limit the scope thereof. Any modification of the embodiments should fall within the scope of the present invention.

What is claimed is:

1. A device for cleaning a static precipitator, comprising:

an oil-collecting sink two ends of which are respectively disposed with an air inlet and an air outlet, the oil-collecting sink being further disposed with an oil draining pipe communicating with an outer side;

multiple static panels parallelly arranged in the oil-collecting sink, each two adjacent static panels being charged with reverse high DC voltage; and at least one hot air filling pipe disposed at one end of the oil-collecting sink near the air inlet, whereby hot air is filled into the oil-collecting sink through the hot air filling pipe for heating and melting the oil dirt attaching to the static panels, the molten oil dirt then dropping down.

2. A device as claimed in claim 1, wherein the oil-collecting sink is further disposed with at least one steam filling pipe beside the hot air filling pipe, whereby steam is filled into the oil-collecting sink through the steam filling pipe to further clean up the oil dirt remaining on the static panels.

3. A device as claimed in claim 1, wherein a flow-guiding filtering screen is disposed in the front end of the oil-collecting sink near the air inlet.

4. A device as claimed in claim 2, wherein a flow-guiding filtering screen is disposed in the front end of the oil-collecting sink near the air inlet.

5. A device as claimed in claim 1, wherein an activated carbon filter device is disposed in the rear end of the oil-collecting sink near the air outlet.

6. A device as claimed in claim 2, wherein an activated carbon filter device is disposed in the rear end of the oil-collecting sink near the air outlet.

7. A device as claimed in claim 3, wherein an activated carbon filter device is disposed in the rear end of the oil-collecting sink near the air outlet.

8. A device as claimed in claim 4, wherein an activated carbon filter device is disposed in the rear end of the oil-collecting sink near the air outlet.

9. A device as claimed in claim 1, wherein a bottom of the oil-collecting sink is disposed with a recessed collecting section under the static panels for collecting the molten oil dirt dropping thereinto.

10. A device as claimed in claim 2, wherein a bottom of the oil-collecting sink is disposed with a recessed collecting section under the static panels for collecting the molten oil dirt dropping thereinto.

11. A device as claimed in claim 9, wherein an oil-draining pipe is installed at a bottom of the collecting section for draining the oil dirt to an oil-collector.

12. A device as claimed in claim 10, wherein an oil-draining pipe is installed at a bottom of the collecting section for draining the oil dirt to an oil-collector.

13. A device as claimed in claim 1, wherein a fire device is mounted outside the oil-collecting sink with a nozzle extending into the oil-collecting sink, a thermosensor of the fire device serving to detect the temperature, in the case of abnormal temperature, the thermosensor being able to in time activate the fire device, making the nozzle inject fire-extinguishing material into the oil-collecting sink.

14. A device as claimed in claim 2, wherein a fire device is mounted outside the oil-collecting sink with a nozzle extending into the oil-collecting sink, a thermosensor of the fire device serving to detect the temperature, in the case of abnormal temperature, the thermosensor being able to in time activate the fire device, making the nozzle inject fire-extinguishing material into the oil-collecting sink.

15. A device as claimed in claim 1, wherein sealing devices are disposed near two ends of the oil-collecting sink for sealing the air inlet and air outlet as necessary.

16. A device as claimed in claim 2, wherein sealing devices are disposed near two ends of the oil-collecting sink for sealing the air inlet and air outlet as necessary.

17. A device as claimed in claim 3, wherein sealing devices are disposed near two ends of the oil-collecting sink for sealing the air inlet and air outlet as necessary.

18. A device as claimed in claim 4, wherein sealing devices are disposed near two ends of the oil-collecting sink for sealing the air inlet and air outlet as necessary.

19. A device as claimed in claim 5, wherein sealing devices are disposed near two ends of the oil-collecting sink for sealing the air inlet and air outlet as necessary.

20. A device as claimed in claim 6, wherein sealing devices are disposed near two ends of the oil-collecting sink for sealing the air inlet and air outlet as necessary.

21. A device as claimed in claim 7, wherein sealing devices are disposed near two ends of the oil-collecting sink for sealing the air inlet and air outlet as necessary.

22. A device as claimed in claim 8, wherein sealing devices are disposed near two ends of the oil-collecting sink for sealing the air inlet and air outlet as necessary.

23. A device as claimed in claim 13, wherein sealing devices are disposed near two ends of the oil-collecting sink for sealing the air inlet and air outlet as necessary.

24. A device as claimed in claim 14, wherein sealing devices are disposed near two ends of the oil-collecting sink for sealing the air inlet and air outlet as necessary.

25. A device as claimed in claim 15, wherein two ends of the oil-collecting sink are disposed with a bypass, whereby when the air inlet and air outlet are sealed by the sealing devices, the bypass is opened, serving as an air passage.

26. A device as claimed in claim 16, wherein two ends of the oil-collecting sink are disposed with a bypass, whereby when the air inlet and air outlet are sealed by the sealing devices, the bypass is opened, serving as an air passage.

27. A device as claimed in claim 17, wherein two ends of the oil-collecting sink are disposed with a bypass, whereby when the air inlet and air outlet are sealed by the sealing devices, the bypass is opened, serving as an air passage.

28. A device as claimed in claim 18, wherein two ends of the oil-collecting sink are disposed with a bypass, whereby when the air inlet and air outlet are sealed by the sealing devices, the bypass is opened, serving as an air passage.

29. A device as claimed in claim 19, wherein two ends of the oil-collecting sink are disposed with a bypass, whereby when the air inlet and air outlet are sealed by the sealing devices, the bypass is opened, serving as an air passage.

30. A device as claimed in claim 20, wherein two ends of the oil-collecting sink are disposed with a bypass, whereby when the air inlet and air outlet are sealed by the sealing devices, the bypass is opened, serving as an air passage.

31. A device as claimed in claim 21, wherein two ends of the oil-collecting sink are disposed with a bypass, whereby when the air inlet and air outlet are sealed by the sealing devices, the bypass is opened, serving as an air passage.

32. A device as claimed in claim 22, wherein two ends of the oil-collecting sink are disposed with a bypass, whereby when the air inlet and air outlet are sealed by the sealing devices, the bypass is opened, serving as an air passage.

33. A device as claimed in claim 23, wherein two ends of the oil-collecting sink are disposed with a bypass, whereby when the air inlet and air outlet are sealed by the sealing devices, the bypass is opened, serving as an air passage.

34. A device as claimed in claim 24, wherein two ends of the oil-collecting sink are disposed with a bypass, whereby when the air inlet and air outlet are sealed by the sealing devices, the bypass is opened, serving as an air passage.

* * * * *